US011939092B2

(12) United States Patent
Biondi et al.

(10) Patent No.: US 11,939,092 B2
(45) Date of Patent: Mar. 26, 2024

(54) DEVICE FOR PROCESSING A CONTINUOUS WEB

(71) Applicant: AZIONARIA COSTRUZIONI MACCHINE AUTOMATICHE A.C.M.A. S.P.A., Bologna (IT)

(72) Inventors: Andrea Biondi, Bologna (IT); Luca Cavazza, Bologna (IT)

(73) Assignee: AZIONARIA COSTRUZIONI MACCHINE AUTOMATICHE A.C.M.A. S.P.A., Bologna (IT)

( * ) Notice: Subject to any disclaimer, the term of this patent is extended or adjusted under 35 U.S.C. 154(b) by 292 days.

(21) Appl. No.: 17/414,229

(22) PCT Filed: Dec. 16, 2019

(86) PCT No.: PCT/IB2019/060844
§ 371 (c)(1),
(2) Date: Jun. 15, 2021

(87) PCT Pub. No.: WO2020/128782
PCT Pub. Date: Jun. 25, 2020

(65) Prior Publication Data

US 2022/0048653 A1 Feb. 17, 2022

(30) Foreign Application Priority Data

Dec. 17, 2018 (IT) ..... 102018000011153

(51) Int. Cl.
*B65B 29/02* (2006.01)
*B65B 41/16* (2006.01)
(Continued)

(52) U.S. Cl.
CPC ..... *B65B 29/022* (2017.08); *B65B 41/16* (2013.01); *B65B 57/04* (2013.01); *B65B 61/08* (2013.01);
(Continued)

(58) Field of Classification Search
CPC ..... B65B 7/01; B65B 29/022; B65B 41/16; B65B 57/04; B65B 61/005; B65B 61/08;
(Continued)

(56) References Cited

U.S. PATENT DOCUMENTS 3,983,774 A * 10/1976 Seragnoli ..... B65B 41/16 53/64
4,209,956 A * 7/1980 Clayson et al. ..... B65B 41/16 53/389.3
(Continued)

FOREIGN PATENT DOCUMENTS

AU 5406990 A 11/1990
CN 1046714 A 11/1990
(Continued)

OTHER PUBLICATIONS

English translation of Chinese Office Action dated Sep. 5, 2022 from counterpart Chinese Patent Application No. 201980083802.4.
(Continued)

*Primary Examiner* — Stephen F. Gerrity
(74) *Attorney, Agent, or Firm* — SHUTTLEWORTH & INGERSOLL, PLC; Timothy J. Klima

(57) ABSTRACT

A device for processing a continuous web includes a feed station for feeding the web in a feed direction towards a cutting station for cutting the web to a cutting length into individual segments of web that are disc-shaped. A further feed station feeds each segment. A first cutting unit cuts the web into the segments and a second cutting unit includes a cutting element configured to sever the web across a full width in a direction transverse to the feed direction. A drive unit is configured to issue a command to move the cutting element from a non-operating position, where the web is fed by the feed station to the first cutting unit through the second cutting unit, to an operating position, where the web is
(Continued)

severed by the cutting element to interrupt feeding of the web to the first cutting unit.

7 Claims, 3 Drawing Sheets

(51) Int. Cl.
*B65B 57/04* (2006.01)
*B65B 61/08* (2006.01)
*B65H 35/08* (2006.01)

(52) U.S. Cl.
CPC . *B65H 35/08* (2013.01); *B65H 2301/515323* (2013.01); *B65H 2301/51538* (2013.01); *B65H 2406/15* (2013.01); *B65H 2406/33* (2013.01)

(58) Field of Classification Search
CPC ..... B65H 35/08; B65H 2301/515323; B65H 2301/51538; B65H 2406/15; B65H 2406/33
USPC ..... 53/67
See application file for complete search history.

(56) References Cited

U.S. PATENT DOCUMENTS

| | | | | |
|---|---|---|---|---|
| 4,273,606 | A * | 6/1981 | Trilli | B65B 7/01 156/764 |
| 5,845,464 | A * | 12/1998 | Draghetti | B65B 11/10 53/64 |
| 2014/0230370 | A1 | 8/2014 | Bianchi | |
| 2017/0361952 | A1* | 12/2017 | Küffner et al. | B65B 7/01 |
| 2020/0290797 | A1* | 9/2020 | Steffen | B65B 29/022 |

FOREIGN PATENT DOCUMENTS

| | | | |
|---|---|---|---|
| CN | 101073888 | A | 11/2007 |
| CN | 105408211 | A | 3/2016 |
| CN | 108602639 | A | 9/2018 |
| EP | 2483160 | A2 | 8/2012 |
| EP | 3024734 | A1 | 6/2016 |
| JP | 2017109322 | A | 6/2017 |

OTHER PUBLICATIONS

International Search Report and Written Opinion dated Apr. 6, 2020 from counterpart International Patent Application No. PCT/IB2019/060844.

* cited by examiner

DEVICE FOR PROCESSING A CONTINUOUS WEB

This application is the National Phase of International Application PCT/IB2019/060844 filed Dec. 16, 2019 which designated the U.S.

This application claims priority to Italian Patent Application 102018000011153 filed Dec. 17, 2018, the entirety of which is incorporated by reference herein.

TECHNICAL FIELD

This invention relates to a device for processing a continuous web.

More specifically, the device addresses the field of machines for making capsules containing infusion substances, such as coffee, for example.

The device for processing a continuous web allows segments of web to be obtained by cutting the web according to a predetermined cutting length and to be delivered to a feed station by which the segments of web are fed.

The continuous web is unwound from a roll and fed continuously to a cutting unit.

BACKGROUND ART

Typically, the cutting unit used comprises an opposing roller and a cutting roller, which acts in conjunction with the opposing roller to cut the web into individual segments according to the cutting length.

The opposing roller and the cutting roller operate continuously and the continuous web is therefore cut uninterruptedly, without the possibility of stopping the cutting unit.

In this context, the segments fed out of the cutting unit and not received by a respective destination article have to be rejected.

For example, in the technical field of machines for making capsules containing infusion substances, a cup containing the infusion substance receives a filtering element intended to be welded to the inside of the cup.

As is known, the filtering elements, which are obtained by cutting a continuous web, are delivered to the cup feed line even if one or more cups are not there to receive them.

The filtering elements not received by respective cups are rejected.

AIM OF THE INVENTION

In order to avoid rejecting segments of continuous web, this invention, according to one aspect of it, provides a device for processing a continuous web, preferably of filter material, comprising a feed station for feeding a continuous web defining a direction of feed towards a cutting station for cutting the continuous web, according to a cutting length, into individual segments of continuous web, preferably of filter material, and specifically disc-shaped, and a feed station for feeding each individual segment obtained by cutting the continuous web.

The device comprises a first cutting unit comprising an opposing element, which rotates about its axis of rotation, and a cutting member, which rotates about its axis of rotation and which acts in conjunction with the opposing element at the cutting station to obtain individual segments of web from the continuous web according to the cutting length.

The device comprises a second cutting unit for cutting the continuous web, located between the feed station for feeding the continuous web and the first cutting unit, and comprising at least one cutting element configured to sever the continuous web across the full width in a direction transverse to the direction of feed of the continuous web.

A drive unit is configured to issue a command to move the cutting element from a non-operating position, where the continuous web is fed by the feed station to the first cutting unit through the second cutting unit, to an operating position, where the continuous web is severed by the cutting element to interrupt feeding of the continuous web to the first cutting unit.

BRIEF DESCRIPTION OF THE DRAWINGS

Further features of the invention and its advantages are more apparent in the following non-limiting description of preferred but non-exclusive embodiments of a device for processing a continuous web, as illustrated in the accompanying drawings, in which.

DETAILED DESCRIPTION OF PREFERRED EMBODIMENTS OF THE INVENTION

Figure 1:
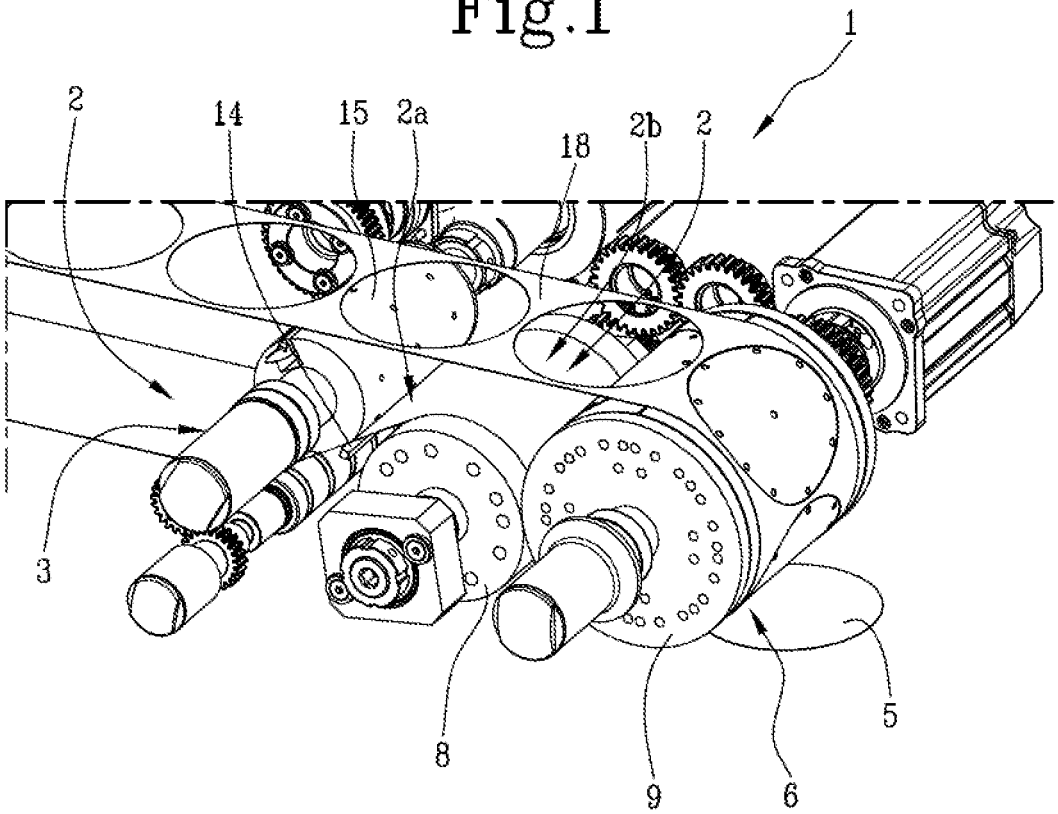
FIGS. 1 to 4 illustrate a device for processing a continuous web according to this invention during some steps in its operation.

The reference numeral 1 denotes a device for processing a continuous web according to this invention.

By continuous web 2 is meant preferably a web of filter material.

The device 1 comprises a feed station 3 for feeding the continuous web 2 defining a direction of feed D towards a cutting station 4 for cutting the continuous web 2.

The continuous web 2 is unwound from a roll, not illustrated, upstream of the feed station 3, in the feed direction D of the continuous web 2.

At the feed station 3, the device 1 comprises a first unwinding roller 28, which rotates about its axis of rotation 28*a*, and a second unwinding roller 29, which rotates about its axis of rotation 29*a*, for unwinding the continuous web 2.

The first unwinding roller 28 is a motor-driven roller.

At the cutting station 4, the continuous web 2 is cut into individual segments 5 according to a cutting length and resulting in a cut web 18, or waste.

Preferably, the continuous web 2 is cut into individual, disc-shaped segments 5.

The device 1 also comprises a feed station 6 for feeding each individual segment 5 that has been obtained by cutting the continuous web 2.

The device 1 comprises a first cutting unit 7 comprising an opposing element 8, which rotates about its axis of rotation 8*a*, and a cutting member 9, which rotates about its axis of rotation 9*a* and which acts in conjunction with the opposing element 8 at the cutting station 4 to obtain individual segments 5 from the continuous web 2 according to the cutting length T.

The axes of rotation 8*a* and 9*a* are parallel to each other.

In particular, in this embodiment, the axes of rotation 8*a* and 9*a* are horizontal.

The opposing element 8 comprises a roller 12 whose cylindrical surface acts as an anvil for the cutting member 9.

The roller 12 of the opposing element 8 is a suction roller 12 that is to say, it comprises suction means, not illustrated, which hold the continuous web 2 in place while it is being conveyed towards the cutting station 4.

The cutting member 9 comprises a roller 10 whose cylindrical surface is provided with a plurality of cutting elements 11.

The cutting elements 11 and the opposing element 8 are tangent to each other at the cutting station 4.

Each cutting element 11 is shaped according to the shape of the segment 5.

In the embodiment illustrated, each cutting element 11 of the cutting member 9 defines a circumference so that the segment 5 obtained from the continuous web 2 is a circle.

The cutting elements 11 of the cutting member 9 are disposed on the cylindrical surface of the cutting member 9 according to the cutting length T.

Each cutting element 11 on the cylindrical surface of the cutting member 9 is spaced by the cutting length T from the cutting element 11 following it in the direction of rotation of the cutting member 9.

The roller 10 of the cutting member 9 is a suction roller 10 that is to say, it comprises suction means configured to hold the cut web 18 in place from the cutting station 4 on, with reference to the direction of rotation of the cutting member 9.

In a preferred embodiment, the cutting member 9 comprises blowing means configured to expel, at the feed station 6, the segment 5 cut from the cut web 18.

It should be noted that once the segment 5 has been expelled from the cut web 18, it remains on the cutting member 9 until it is received by conveying means 27 for conveying the cut web 18, or waste.

The conveying means 27 for conveying the cut web 18, or waste, comprise an extractor 19 configured to extract at least the cut web 18 from the first cutting unit 7.

According to this invention, the device 1 comprises a second cutting unit 13 for cutting the continuous web 2, located between the feed station 3 and the first cutting unit 7 for cutting the continuous web 2 and comprising at least one cutting element 14 configured to sever the continuous web 2 across the full width in a direction transverse to the direction of feed D of the continuous web 2, thus defining a leading end 2*a* of the continuous web 2 at the exit of the feed station 3 and a trailing end 2*b* of the continuous web 2 entering the first cutting unit 7 of the cutting station 4.

The cutting element 14 has a straight blade in order to sever the continuous web 2 across the full width of it.

The second cutting unit 13 comprises a roller 15 which rotates about its axis of rotation 15*a* and which has on its external surface at least a first portion 16 adapted to define an anvil for the cutting element 14.

The roller 15 of the second cutting unit 13 is a suction roller 15 that is to say, it comprises suction means, not illustrated.

Figure 5:
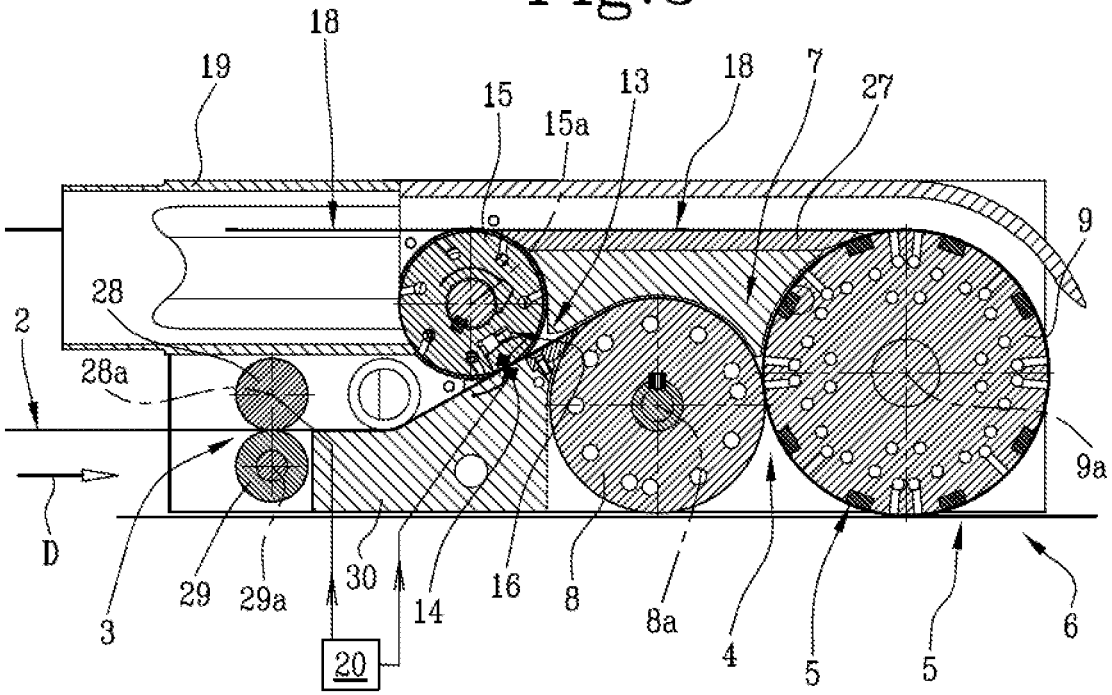
FIG. 5 shows a schematic front view of a device for processing a continuous web according to this invention.

It should be noted that the extractor 19 may be configured to operate on at least part of the surface of the roller 15 of the second cutting unit 13 (see FIG. 5).

The axis of rotation 15*a* is parallel to the axes of rotation 8*a*, 9*a* of the opposing element 8 of the cutting member 9.

In particular, according to this embodiment, the axis of rotation 15*a* of the roller 15 of the second cutting unit 13 is horizontal.

Figure 2:
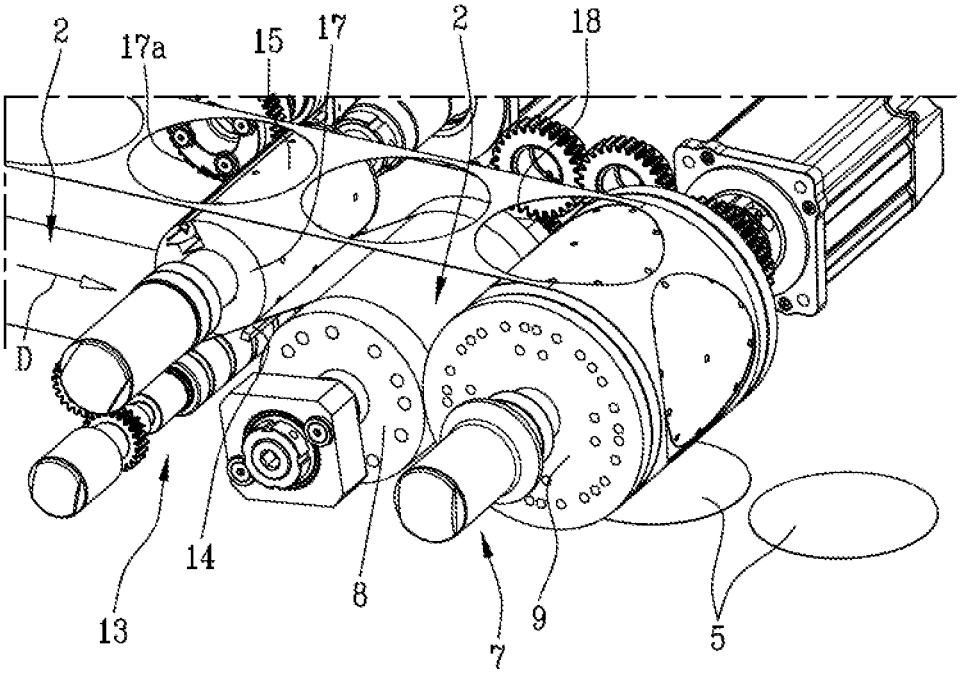
Figure 3:
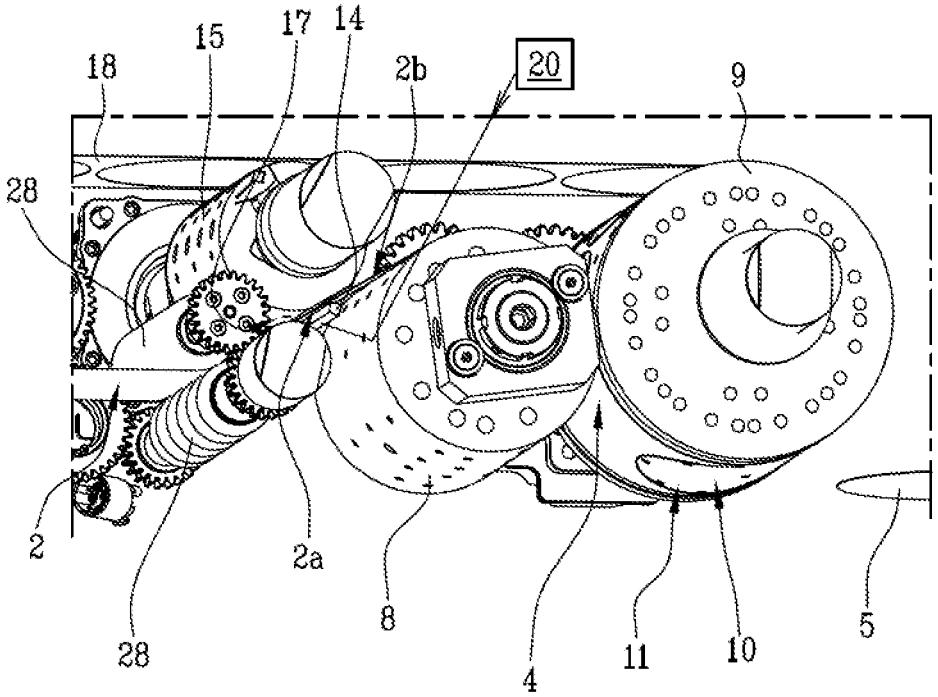
Figure 4:
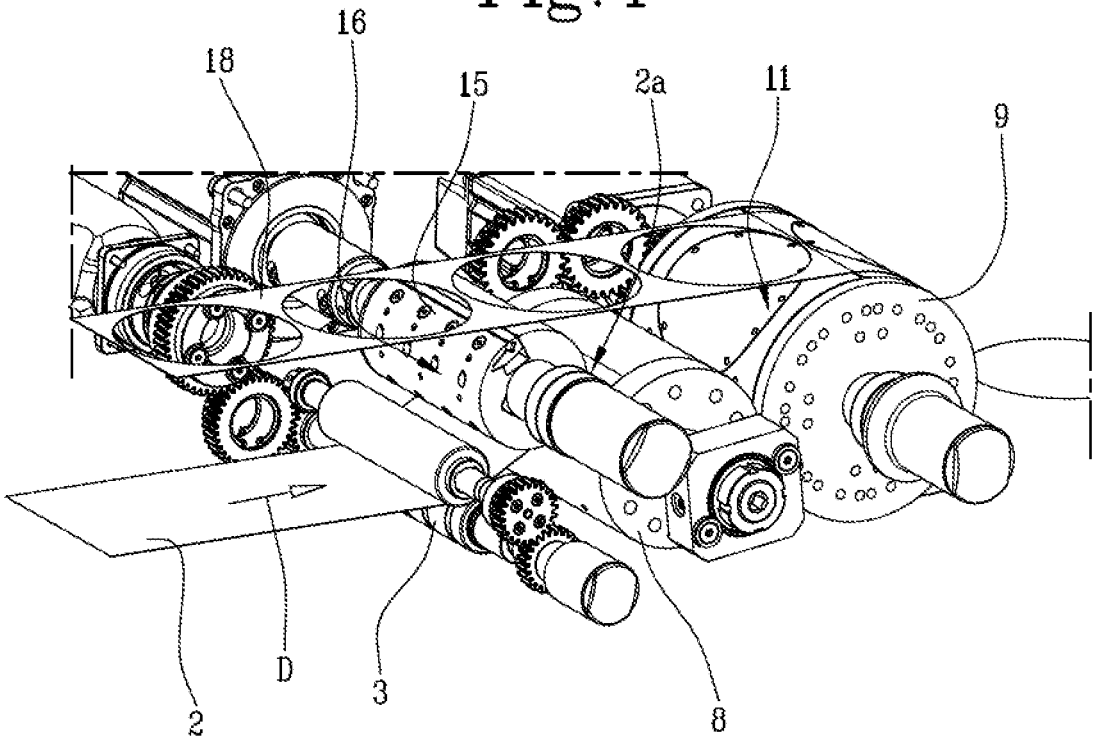

The roller 15 of the second cutting unit 13 has a second portion 17 configured as an inclined surface 17*a* (see FIG. 2) to guide the continuous web 2 while it is being fed from the feed station 3 to the first cutting unit 7.

The first portion 16 and the second portion 17 are spaced from each other by a distance at least equal to the length of a single segment 5.

In this sense, it is preferable for the continuous web 2 to stop being fed to the first cutting unit 7 for a length at least equal to one segment 5 so as to be able to manage the absence of feed of one segment 5 at a time to the feed station 6.

A drive unit 20 is configured to issue a command to move the cutting element 14 from a non-operating position, where the continuous web 2 is fed by the feed station 3 to the cutting unit 7 through the second cutting unit 13, to an operating position, where the continuous web 2 is severed by the cutting element 14 to interrupt feeding of the continuous web 2 to the first cutting unit 7.

Once the continuous web 2 has been severed, the cutting element 14 is configured to switch from the operating position to the non-operating position.

The drive unit 20 is configured to drive the roller 15 of the second cutting unit 13 in rotation in such a way that the first portion 16 of its outer surface, which is adapted to define the anvil for the cutting element 14, faces the cutting element 14 during the passage from the non-operating position to the operating position.

The drive unit 20 is configured to set the first unwinding roller 28 in rotation according to the movement of the cutting element 14 from the non-operating position to the operating position.

In use, the first cutting unit 7 operates uninterruptedly on the continuous web 2 to obtain the segments 5 by cutting the continuous web 2 according to the cutting length T.

In other words, in the condition where the cutting element 14 is at the non-operating position, the continuous web 2 advances uninterruptedly from the feed station 3, through the rotation of the first unwinding roller 28 and of the second unwinding roller 29, to the cutting station 7, through the rotation of the opposing element 8 and of the cutting member 9 about the respective axes of rotation 8*a*, 9*a*.

If the drive unit 20 causes the cutting element 14 to move from the non-operating position to the operating position, the continuous web 2 is severed across its full width, thereby defining an end 2*a* of the continuous web 2.

The drive unit 20 coordinates the movement of the cutting element 14 from the non-operating position to the operating position with the stopping of the rotation of the first unwinding roller 28.

Stopping the feeding of the continuous web 2 with the leading end 2*a* is determined by the number of work cycles needed for the first cutting unit 7 to stop cutting one or more segments 5.

Once the continuous web 2 has been severed, the first cutting unit 7 continues cutting the web 2 until it reaches the trailing end 2*b*, whilst the leading end 2*a* of the remaining web 2 is paused and kept on standby, ready to start being fed from the second cutting unit 13 to the first cutting unit 7 when the drive unit 20 sets the first unwinding roller 28 in rotation again.

It should be noted that the continuous web 2 that has been cut to make the segments 5—that is to say, when it exits the cutting station 4—is waste 18 which may be continuous or discontinuous depending on whether the continuous web 2 has been cut at the first cutting unit 7.

During the pause, the leading end 2*a* of the continuous web 2 is supported by the guide 30.

After elapse of the pause time, corresponding to the number of work cycles needed for the first cutting unit 7 to stop cutting one or more segments 5, the drive unit 20 starts the rotation of the roller 15 of the second cutting unit 13 so that its second portion 17 faces the continuous web 2.

After elapse of the pause time, corresponding to the number of work cycles needed for the first cutting unit 7 to stop cutting one or more segments 5, the drive unit 20 starts the rotation of the first unwinding roller 28 to feed the continuous web 2 from the second cutting unit 13 to the first cutting unit 7.

Figure 6:
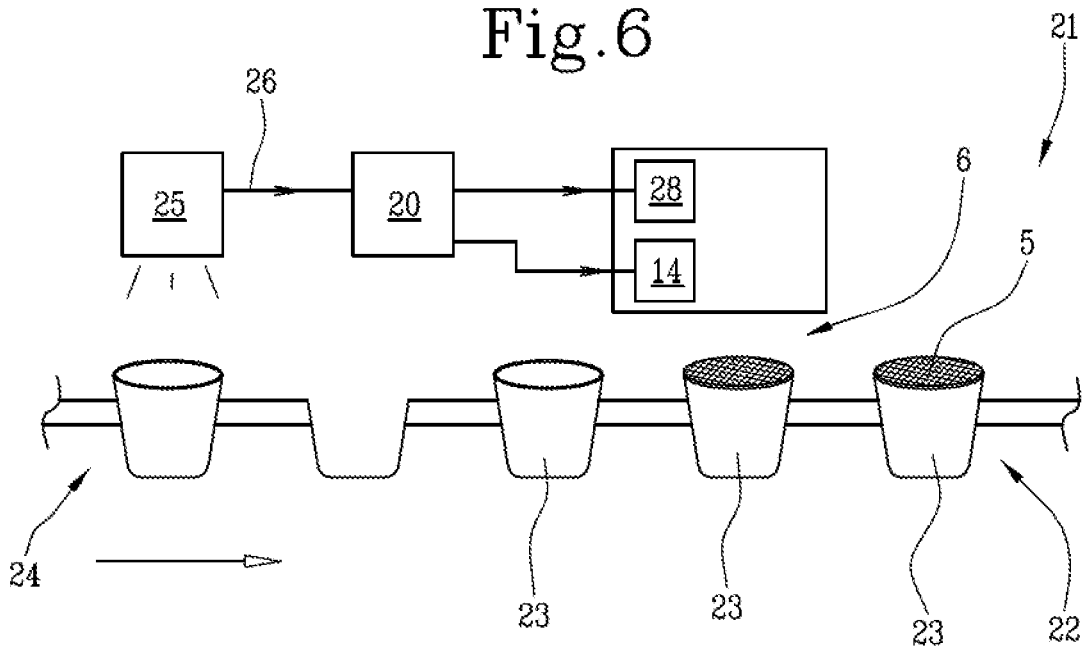
FIG. 6 shows a schematic view of a machine for making coffee capsules and comprising a device for processing a continuous web according to this invention.

FIG. 6 schematically represents a machine 21 for making capsules 22, each comprising a cup 23 for containing an infusion substance, preferably coffee, and a filtering element 5 located in the cup 23 (see FIG. 6).

The filtering element 5 is intended to be welded to the inside of the cup 23.

The machine 21 comprises a feed line 24 for feeding the cups 23 and a device 1 for processing the continuous web 2.

The machine 21 comprises a detecting device 25 for detecting the cup 23 along the feed line 24.

The drive unit 20 is configured to receive a detection signal 26 indicating the presence or absence of the cup 23 along the feed line 24.

The drive unit 20 is configured to issue a command to move the cutting element 14 from the non-operating position to the operating position if the drive unit 20 establishes the absence of the cup 23 at the feed station 6 for feeding the filtering element 5.

Each time the drive unit 20 establishes the absence of a cup 23 at the feed station 6, it issues a command to move the cutting element 14 from the non-operating position to the operating position to sever the continuous web 2 across its width and to stop feeding the continuous web 2 to the first cutting unit 7.

It should be noted that to resume feeding the continuous web 2 that has been severed by the cutting element 14, the considerations set out above apply.

In short, after elapse of the pause time, corresponding to the number of work cycles needed for the first cutting unit 7 to stop cutting one or more filter elements 5 and to the number of absent cups 23 along the feed line 24, the drive unit 20 starts the rotation of the first unwinding roller 28 to feed the continuous web 2 from the second cutting unit 13 to the first cutting unit 7.

The invention claimed is:

1. A device for processing a continuous web of filter material, comprising:

a feed station for feeding a continuous web defining a direction of feed towards a cutting station for cutting the continuous web, according to a cutting length, into individual disc-shaped segments of the continuous web, and a feed station for feeding each of the individual disc-shaped segments obtained by cutting the continuous web;

a first cutting unit comprising an opposing element, which rotates about a first axis of rotation, and a cutting member, which rotates about a third axis of rotation and which acts in conjunction with the opposing element at the cutting station to obtain the individual disc-shaped segments from the continuous web according to the cutting length;

a second cutting unit for cutting the continuous web, located between the feed station for feeding the continuous web and the first cutting unit, and comprising at least one cutting element configured to sever the continuous web across a full width thereof in a direction transverse to the direction of feed of the continuous web;

a drive unit configured to issue a command to move the at least one cutting element from a non-operating position, where the continuous web is fed by the feed station to the first cutting unit through the second cutting unit, to an operating position, where the continuous web is severed by the at least one cutting element to interrupt feeding of the continuous web to the first cutting unit;

wherein the second cutting unit comprises a roller which rotates about a second axis of rotation and which has on an external surface a first portion adapted to define an anvil for the at least one cutting element;

wherein the roller of the second cutting unit has a second portion configured as an inclined surface to guide the continuous web during feeding from the feed station to the first cutting unit.

2. The device according to claim 1, wherein at the feed station, the device comprises at least a first unwinding roller which rotates about a fourth axis of rotation; the drive unit being configured to drive the first unwinding roller in rotation according to the movement of the at least one cutting element from the non-operating position to the operating position, or from the operating position to the non-operating position.

3. The device according to claim 1, wherein the drive unit is configured to drive the roller in rotation such that the first portion, faces the at least one cutting element during the passage from the non-operating position to the operating position.

4. The device according to claim 1, and further comprising a conveying device for conveying the cut web, or waste, out of the first cutting unit; the conveying device comprising an extractor configured to extract at least the cut web from the first cutting unit.

5. A machine for making capsules, each of the capsules comprising a cup for containing an infusion substance, and a filtering element located in the cup, the machine comprising:

a device for processing a continuous web of filter material, comprising:

a feed station for feeding a continuous web defining a direction of feed towards a cutting station for cutting the continuous web, according to a cutting length, into individual disc-shaped segments of the continuous web, and a feed station for feeding each of the individual disc-shaped segments obtained by cutting the continuous web;

a first cutting unit comprising an opposing element, which rotates about a first axis of rotation, and a cutting member, which rotates about a third axis of rotation and which acts in conjunction with the opposing element at the cutting station to obtain the individual disc-shaped segments from the continuous web according to the cutting length;

a second cutting unit for cutting the continuous web, located between the feed station for feeding the continuous web and the first cutting unit, and comprising at least one cutting element configured to sever the continuous web across a full width thereof in a direction transverse to the direction of feed of the continuous web;

a drive unit configured to issue a command to move the at least one cutting element from a non-operating position, where the continuous web is fed by the feed station to the first cutting unit through the second cutting unit, to an operating position, where the continuous web is severed by the at least one cutting element to interrupt feeding of the continuous web to the first cutting unit;

wherein the continuous web is a web of filter material and the individual disc-shaped segments are the filtering elements;

a detecting device for detecting the cup along the device for processing; the drive unit being configured to receive a detection signal from the detecting device indicating the cup along the device for processing and to establish an absence of the cup at the feed station for feeding each of the individual disc-shaped segments;

the drive unit being configured to issue a command to move the at least one cutting element of the second cutting unit from the non-operating position to the operating position if the drive unit establishes the absence of the cup at the feed station for feeding each of the individual disc-shaped segments.

6. A method for making capsules, comprising:

providing a machine for making capsules, each of the capsules comprising a cup for containing an infusion substance, and a filtering element located in the cup, the machine comprising:

a device for processing a continuous web of filter material, comprising:

a feed station for feeding a continuous web defining a direction of feed towards a cutting station for cutting the continuous web, according to a cutting length, into individual disc-shaped segments of the continuous web, and a feed station for feeding each of the individual disc-shaped segments obtained by cutting the continuous web;

a first cutting unit comprising an opposing element, which rotates about a first axis of rotation, and a cutting member, which rotates about a third axis of rotation and which acts in conjunction with the opposing element at the cutting station to obtain the individual disc-shaped segments from the continuous web according to the cutting length;

a second cutting unit for cutting the continuous web, located between the feed station for feeding the continuous web and the first cutting unit, and comprising at least one cutting element configured to sever the continuous web across a full width thereof in a direction transverse to the direction of feed of the continuous web;

a drive unit configured to issue a command to move the at least one cutting element from a non-operating position, where the continuous web is fed by the feed station to the first cutting unit through the second cutting unit, to an operating position, where the continuous web is severed by the at least one cutting element to interrupt feeding of the continuous web to the first cutting unit;

wherein the continuous web is a web of filter material and the individual disc-shaped segments are the filtering elements;

a detecting device for detecting the cup along the device for processing; the drive unit being configured to receive a detection signal from the detecting device indicating the cup along the device for processing and to establish an absence of the cup at the feed station for feeding each of the individual disc-shaped segments;

the drive unit being configured to issue a command to move the at least one cutting element of the second cutting unit from the non-operating position to the operating position if the drive unit establishes the absence of the cup at the feed station for feeding each of the individual disc-shaped segments;

wherein each time the drive unit establishes the absence of a cup at the feed station for feeding each of the individual disc-shaped segments, the drive unit issues a command to move the at least one cutting element from the non-operating position to the operating position to cut the continuous web across the full width thereof and to interrupt the feeding of the continuous web to the first cutting unit.

7. The method according to claim 6, wherein stopping the continuous web being fed from the second cutting unit to the first cutting unit is determined by a number of work cycles of the first cutting unit needed to stop cutting one or more of the individual disc-shaped segments.

* * * * *